US006196286B1

(12) United States Patent
Susnjara

(10) Patent No.: US 6,196,286 B1
(45) Date of Patent: Mar. 6, 2001

(54) METHOD AND TOOL FOR MANUFACTURING A SHAPED EDGE, VENEER SURFACED, FURNITURE TOP

(75) Inventor: Kenneth J. Susnjara, Birdseye, IN (US)

(73) Assignee: Thermwood Corporation, Dale, IN (US)

( * ) Notice: Subject to any disclaimer, the term of this patent is extended or adjusted under 35 U.S.C. 154(b) by 0 days.

(21) Appl. No.: 09/473,751

(22) Filed: Dec. 28, 1999

(51) Int. Cl.[7] ..... B27F 1/00; B27M 1/00; B27C 5/00

(52) U.S. Cl. ..... 144/347; 144/134.1; 144/135.2; 144/136.1; 144/90.1; 144/91.2; 144/135.3; 144/219; 144/240; 144/371; 144/36; 409/180

(58) Field of Search ..... 144/82, 84, 90.1, 144/91, 91.2, 134.1, 135.2, 136.1, 198, 203, 218, 219, 240, 241, 345, 346, 347, 135.3, 150, 371; 409/180

(56) References Cited

U.S. PATENT DOCUMENTS

| | | | | |
|---|---|---|---|---|
| 2,705,513 | * | 4/1955 | Moeller | 144/136.1 |
| 2,722,957 | * | 11/1955 | Marvosh | 144/135.2 |
| 2,823,713 | * | 2/1958 | Goldsmith | 144/136.1 |
| 2,915,095 | * | 12/1959 | Pelto | 144/135.2 |
| 2,952,281 | * | 9/1960 | Weber | 144/136.1 |
| 2,965,144 | * | 12/1960 | Lowenthal | 144/240 |
| 3,853,160 | * | 12/1974 | Posey | 409/180 |
| 4,127,153 | * | 11/1978 | Cipollone | 144/136.1 |
| 4,787,786 | * | 11/1988 | Freud et al. | 409/180 |

* cited by examiner

*Primary Examiner*—W. Donald Bray
(74) *Attorney, Agent, or Firm*—Lalos & Keegan; Michael N. Lau

(57) ABSTRACT

A method for manufacturing a wood veneer surfaced furniture top with a profiled edge, utilizing a special tool and process, which when used collectively, eliminates the need for certain relatively costly machinery and manufacturing processes.

19 Claims, 7 Drawing Sheets

METHOD AND TOOL FOR MANUFACTURING A SHAPED EDGE, VENEER SURFACED, FURNITURE TOP

FIELD OF THE INVENTION

The present invention is for manufacturing a wood veneer surfaced furniture top with a profiled edge, utilizing a special tool and process, which when used collectively, eliminates the need for certain relatively costly machinery and manufacturing processes.

BACKGROUND OF THE INVENTION

A natural wood surface with an ornamentally shaped edge is generally considered a highly desirable characteristic of quality furniture. These features are commonly used for, but not necessarily limited to, desk tops. Given the relatively high cost of quality solid hardwood, the market for solid wood furniture is limited to a relatively narrow segment of the overall market. It is therefore in the economic interest of furniture manufacturers to employ the use of a thin wood veneer, glued to the surface of a less expensive substrate. The substrate usually consists of a wood fiber composite in a glue matrix that is considerably less expensive than solid wood. The appearance and perceived quality of such a tabletop falls largely into the same realm as the solid wood top, with a much-reduced manufacturing cost.

The method of manufacturing such a composite based furniture top generally consists of attaching a band of solid wood to the edge of the wood composite material. The banded panel is then processed in a wide-belt sander, so as to ensure that the top surface of the band is exactly level with the surface of the composite material. A thin sheet of veneer is then glued to the surface of the banded panel, covering both the composite material and the edge band. The veneer is applied to the surface of the banded panel by means of a veneer press. Such a press utilizes a heated platen under relatively high pressure to press the veneer onto the surface with heat-activated glue.

There is a major economic disadvantage to the above-described process, in that it requires the use of expensive machinery that is dedicated to one singular process. Such expensive, limited use equipment does not fall within the sphere of economic feasibility for most small to moderate sized furniture manufacturers.

SUMMARY OF THE INVENTION

The first object is to develop a scheme, which will permit the use of wood composite panels that have been mass-produced with wood veneer laminated to the surface. The cost of such panels is relatively inexpensive as compared to the custom banded and veneered panel described above.

The second object is to machine the panel in such a way as to allow the attachment of the wood band to the edge of the panel without breaking the continuity of the veneer surface.

The third object is to design a tool and a method to effect the above-described process.

DETAIL DESCRIPTION OF THE INVENTION

Figure 1:
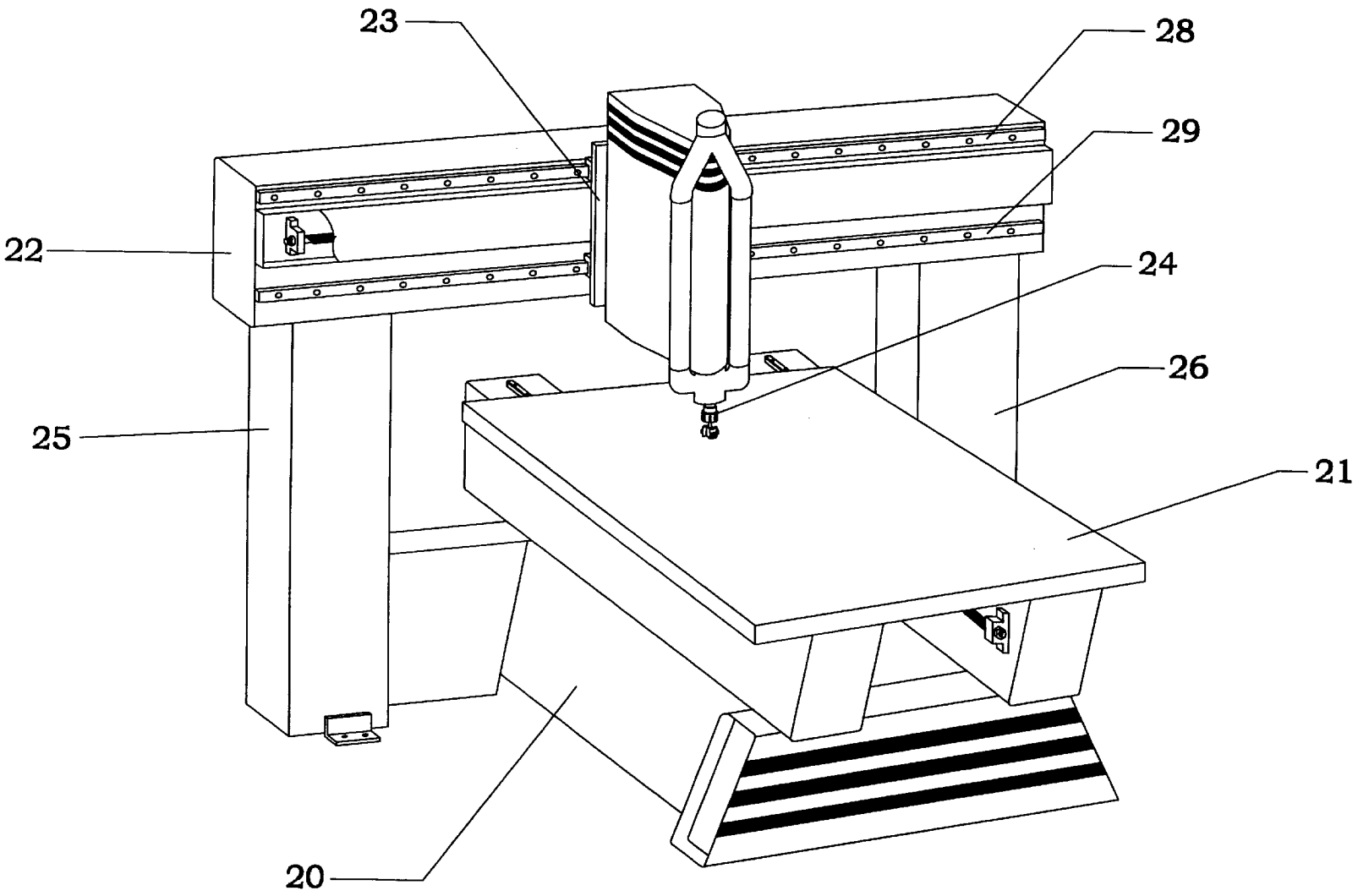
FIG. 1 shows the embodiment of a computer numeric controlled routing machine.

Referring to the drawing in FIG. 1, there is illustrated, an embodiment of a computer numeric controlled (CNC) machining system, which generally includes a base member 20,a worktable 21, a gantry, a toolhead support assembly 23, and an electric spindle 24. The gantry, includes a pair of leg members, 25 and 26, rigidly secured at their lower ends to the base member and a transversely disposed section 22, supported on the leg sections and spanning above the worktable. The base member is formed of steel sections welded together to provide a rigid and stable foundation. Worktable 21, is mounted horizontally with the surface parallel to the x and y axes plane and is adapted to be displaced longitudinally relative to the base member or along a y-axis. The front face of transverse section 22, is provided with a pair of vertically spaced, transversely disposed rails 28, and 29, on which toolhead support assembly 23, is mounted and displaceable transversely or along an x-axis. Electric spindle 24, is mounted on the bottom of the toolhead support assembly and is adapted to be displaced vertically by same. Each of worktable 21, toolhead support assembly 23, and electric spindle 24, is displaceable along its respective axis by a feedscrew arrangement driven by an AC servomotor. The operation of such servomotors is controlled by a programmable computer-numeric controller (CNC) to provide for movement of a tool mounted on the toolhead along a motion path to perform a work function such as routing, shaping, drilling and the like on a workpiece mounted on the worktable. Instead of the worktable being displaceable and the gantry being stationary as described, the worktable can be stationary and the gantry may be displaceable along the Y-axis to provide displacement between the gantry and the worktable.

Figure 2:
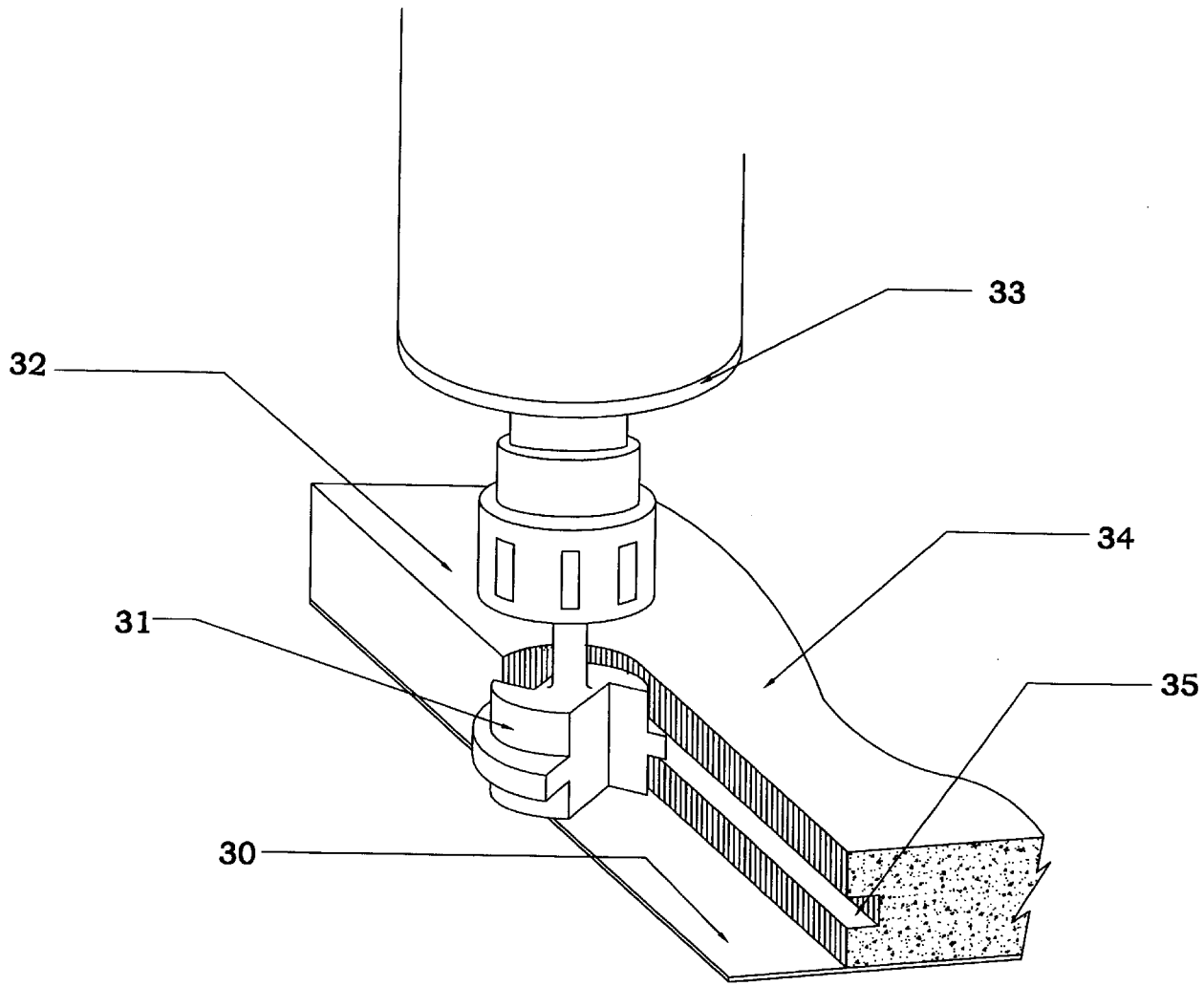
FIG. 2 illustrates a perspective section view of a composite panel being machined by a CNC router, the veneer skin being left intact.
Figure 3:
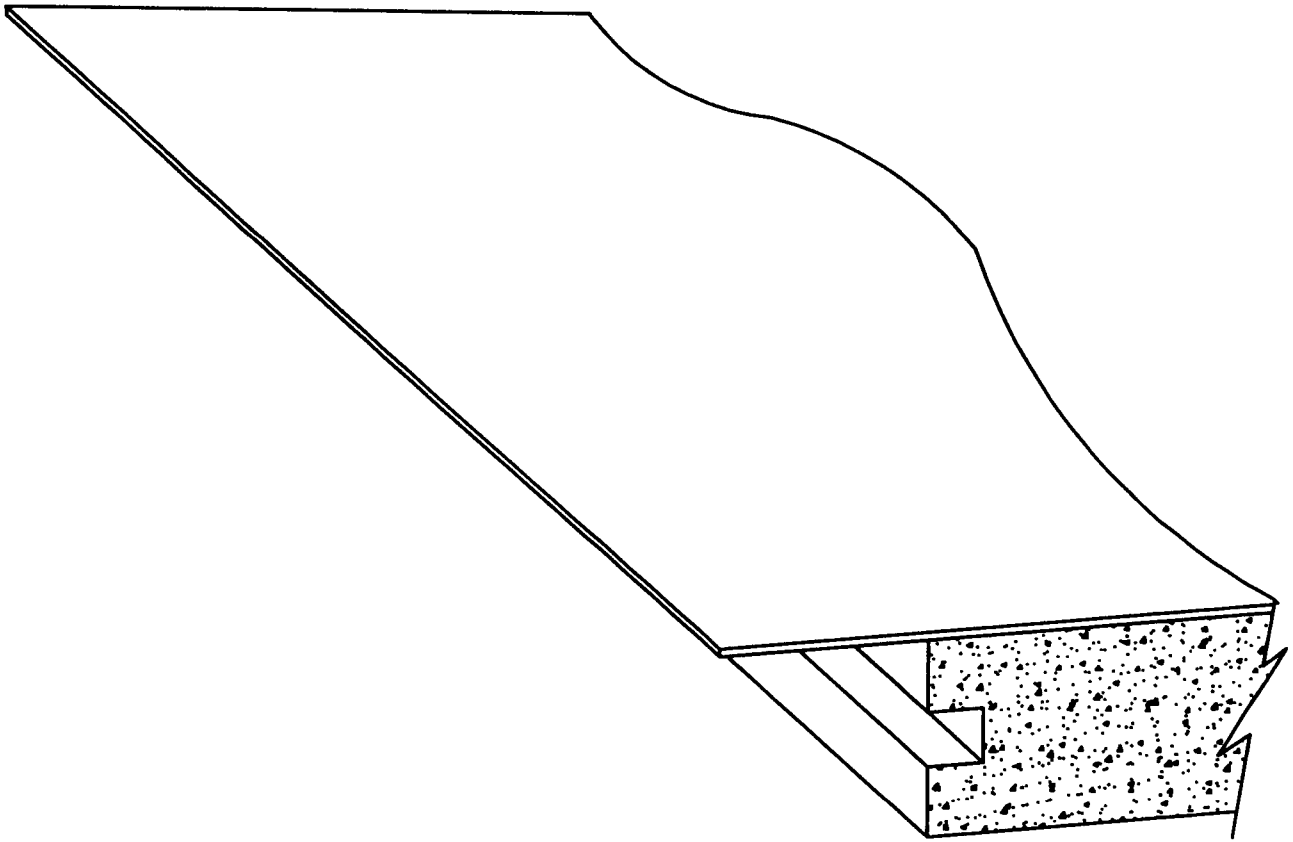
FIG. 3 illustrates a machined composite panel, inverted so that the veneer is on the top-side.
Figure 4:
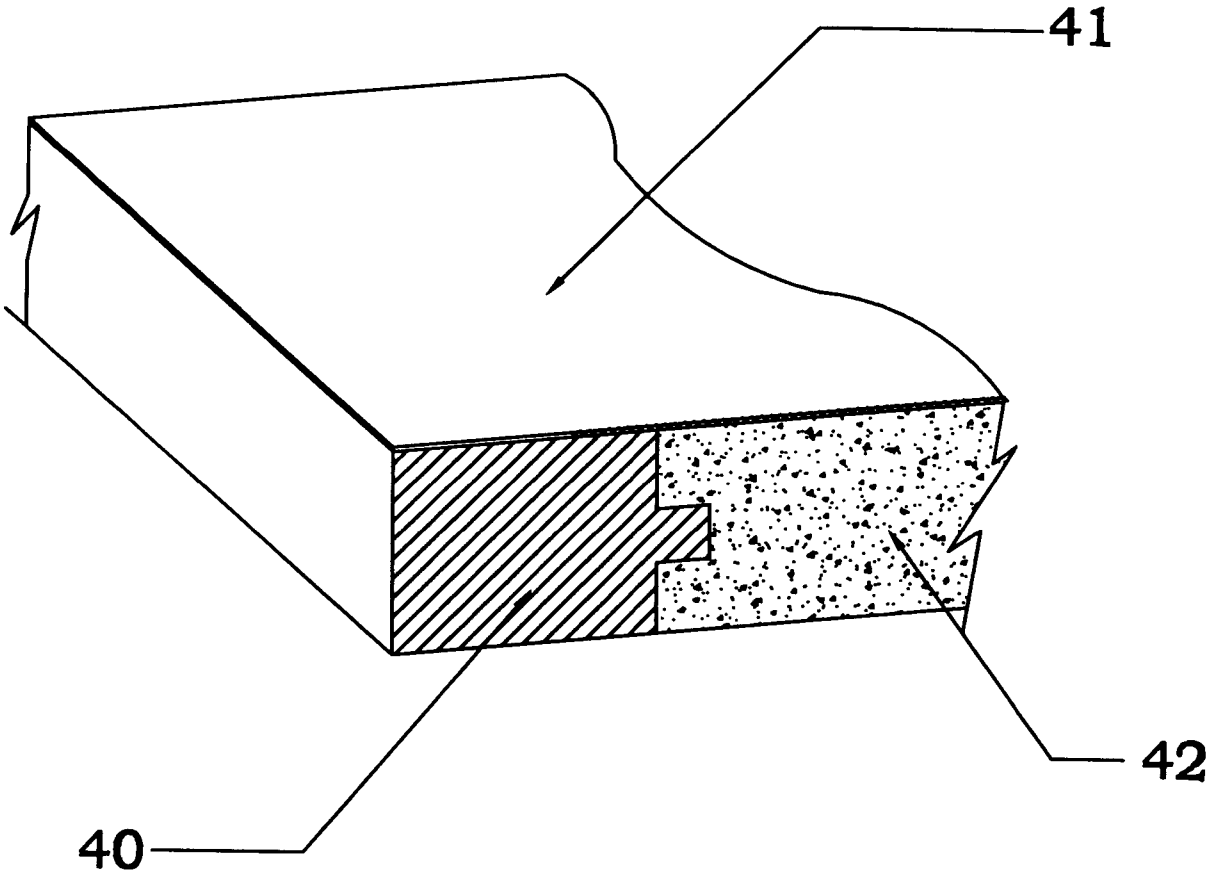
FIG. 4 illustrates the same composite panel with a wooden band glued and clamped into place.
Figure 5:
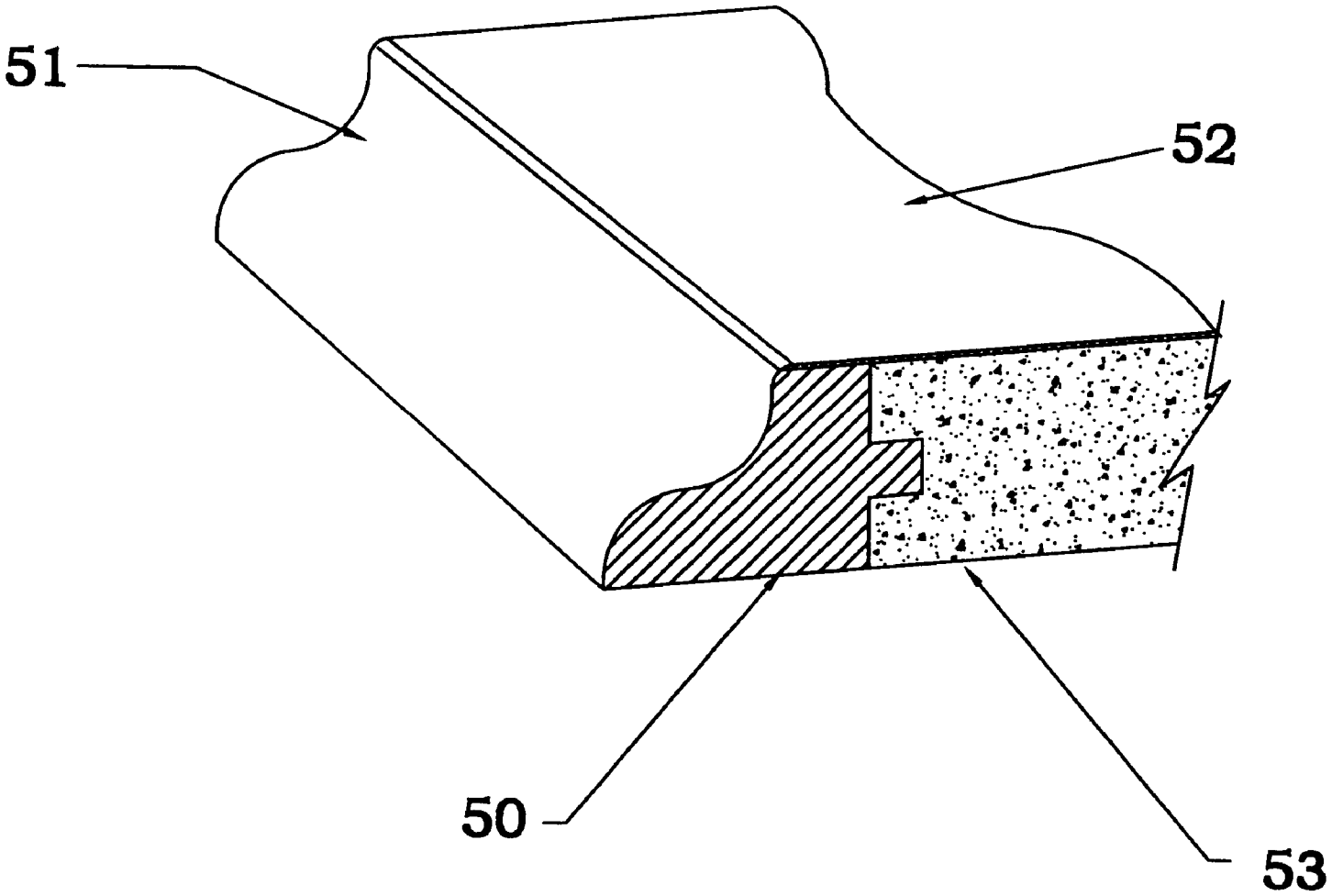
FIG. 5 illustrates the same composite panel with the wood-banded edge shaped into an ornamental design.
Figure 6:
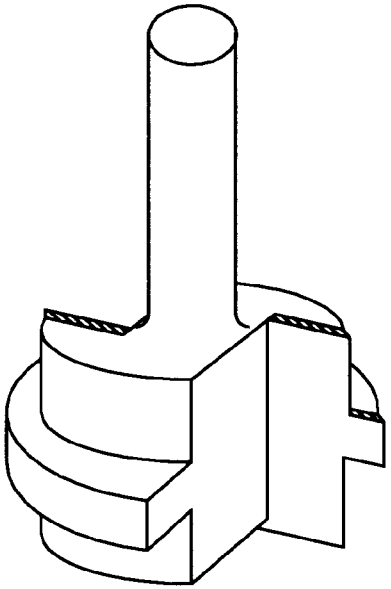
FIG. 6 illustrates a cutter for routing a specific profile into wood or a wood composite material.
Figure 7:
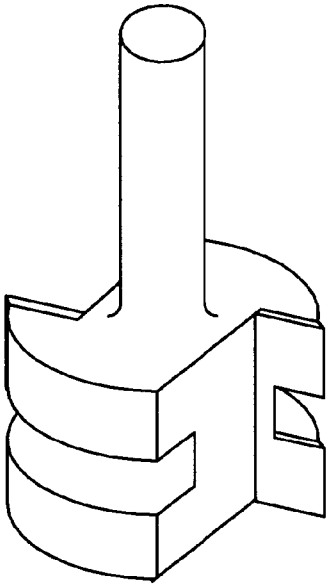
FIG. 7 illustrates a cutter for routing a specific profile into wood or a wood composite material.

FIG. 2 illustrates a section of wood composite material 34, with a veneer face 30, glued to one surface. This composite material is shown inverted with the veneer facing down, being held to the worktable 21. The composite material may be held onto the worktable by vacuum or by any type of mechanical clamping means. The cutting tool, shown in FIG. 6, is installed into a collet on the bottom end of the electric spindle 33. During the actual cutting operation, cutter 31, is disposed in cutting engagement with the material 34 and displaced in such a manner as to effect the cutting of the profile around the perimeter of the material. The material in the path of the cutter is excised and removed down to the glued surface of the veneer 30, but the veneer is left intact. The cutting tool in FIG. 6 is shaped in such a way such that the resulting slot will fit in exact engagement with the key produced by the special cutting tool illustrated in FIG. 7. FIG. 3 illustrates a portion of veneered composite material that has been cut and disposed with the veneered surface facing up. FIG. 4 illustrates the same composite material as illustrated in FIG. 3, disposed and glued in a keyed engagement with a wooden band 40, shaped by the cutter illustrated in FIG. 7. FIG. 5 illustrates the composite panel shown in FIG. 4 with an ornamental profile shaped onto the edge, the veneer surface being blended with the wooden edge band in such a manner that the combined units appear as one piece of wood. The utilization of the CNC machine in this process allows for two important advantages, these advantages being the ability to effect precise adjustment of the cutting depth and the ability to program the cutting path around various shaped profiles of workpiece perimeters. The utilitarian advantage of the CNC machine and the ability to precisely adjust the cutting path depth is fundamental to the success of the operation described herein.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A method of woodworking with a computer numerical controlled machine, comprising a plurality of steps of:

a. securing a layer of veneer in-between a workpiece and a worktable; and b. directing a first toolbit of the computer numerical controlled machine to machine the workpiece so as to expose a side of the veneer.

2. The method of claim 1, further comprising a step of:

c. directing a second toolbit of the computer numerical controlled machine to machine a band workpiece to have a mating pattern with the workpiece.

3. The method of claim 2, further comprising a step of:

d. securing the workpiece and the band workpiece through the mating pattern.

4. The method of claim 3, further comprising a step of:

e. securing the exposed side of the layer of veneer on the band workpiece.

5. The method of claim 3, wherein the workpiece and the band workpiece are secured by adhesives.

6. The method of claim 4, wherein the layer of veneer and the band workpiece are secured by adhesives.

7. The method of claim 1, wherein the first toolbit only machines the workpiece leaving the layer of veneer untouched due to a separating distance substantially equivalent to a thickness of the layer of veneer between the first toolbit and the worktable.

8. The method of claim 2, wherein the mating pattern is one of tongue and groove.

9. The method of claim 2, wherein the band workpiece has a rectangular ornamental design.

10. The method of claim 2, wherein the band workpiece has a non-rectangular ornamental design.

11. The method of claim 6, wherein an edge of the layer of veneer is blended into the ornamental design by sanding.

12. The method of claim 1, wherein the workpiece is a composite board.

13. The method of claim 3, wherein the band workpiece is a piece of solid wood.

14. A method of attaching a band to a workpiece with a layer of veneer adhered thereon, comprising a step of:

a. producing a first pattern on the workpiece by removing a portion of the workpiece and exposing a side of the layer of veneer that was adhered to the workpiece.

15. The method of claim 14, further comprising a step of:

b. producing a second pattern in the band.

16. The method of claim 15, further comprising a step of:

c. securing the band to the workpiece through the first and second patterns.

17. The method of claim 16, further comprising a step of:

d. securing any exposed layer of veneer to a portion of the band.

18. The method of claim 14, wherein the first pattern is one of tongue and groove.

19. The method of claim 15, wherein the second pattern is one of tongue and groove.

* * * * *